US010532596B2

(12) United States Patent
Ko et al.

(10) Patent No.: US 10,532,596 B2
(45) Date of Patent: Jan. 14, 2020

(54) PLASMONIC STRUCTURE HAVING AN IDENTIFIER PATTERN INDICATING A GENUINE PRODUCT AND METHOD OF USE FOR PREVENTING COUNTERFEITING, FALSIFICATION OR REUSE OF THE PRODUCT

(71) Applicant: KOREA INSTITUTE OF SCIENCE AND TECHNOLOGY, Seoul (KR)

(72) Inventors: Hyungduk Ko, Seoul (KR); Kisun Park, Seoul (KR); Ho Seong Jang, Seoul (KR); Il Ki Han, Seoul (KR)

(73) Assignee: Korea Institute of Science and Technology, Seoul (KR)

( * ) Notice: Subject to any disclaimer, the term of this patent is extended or adjusted under 35 U.S.C. 154(b) by 302 days.

(21) Appl. No.: 15/698,913

(22) Filed: Sep. 8, 2017

(65) Prior Publication Data

US 2019/0023044 A1 Jan. 24, 2019

(30) Foreign Application Priority Data

Jul. 24, 2017 (KR) ..... 10-2017-0093746
Aug. 17, 2017 (KR) ..... 10-2017-0103997

(51) Int. Cl.
*B41M 3/14* (2006.01)
*B42D 25/328* (2014.01)
(Continued)

(52) U.S. Cl.
CPC ..... *B41M 3/144* (2013.01); *B42D 25/328* (2014.10); *B42D 25/373* (2014.10);
(Continued)

(58) Field of Classification Search
CPC .... B41M 3/144; B42D 25/373; B42D 25/382; B42D 25/42; B42D 25/47; G09F 3/0292
(Continued)

(56) References Cited

U.S. PATENT DOCUMENTS 8,216,872 B1 * 7/2012 Shieh ..... G02B 5/0242 438/69
2010/0307705 A1 * 12/2010 Rahm ..... B42D 25/29 162/140
2016/0190370 A1 * 6/2016 Ko ..... H01L 31/055 136/257

FOREIGN PATENT DOCUMENTS

KR 10-2009-0092278 A 8/2009
KR 10-2011-0045194 A 5/2011
(Continued)

*Primary Examiner* — Paultep Savusdiphol
(74) *Attorney, Agent, or Firm* — Rabin & Berdo, P.C.

(57) ABSTRACT

A plasmonic structure having an identifier pattern indicating a genuine product for preventing counterfeiting, falsification or reuse, includes a metal layer; a photoconversion pattern layer including a plurality of photoconverting nanoparticles disposed in a pattern on and in direct contact with the metal layer; a metal pattern layer including a plurality of metal particles disposed in a pattern on and in direct contact with the photoconversion pattern layer; and an adhesive film disposed on the metal pattern layer. An identifier pattern indicating a genuine product is easily identified even by visual inspection after irradiation with infrared light irradiation. The plasmonic structure is fundamentally impossible to re-assemble after deformation of the plasmonic structure caused by disassembly of a product or packaging container, thereby preventing counterfeiting, falsification or reuse.

19 Claims, 8 Drawing Sheets

(51) Int. Cl.

| | |
|---|---|
| ***G09F 3/00*** | (2006.01) |
| ***B42D 25/47*** | (2014.01) |
| ***B42D 25/382*** | (2014.01) |
| ***B42D 25/42*** | (2014.01) |
| ***B42D 25/373*** | (2014.01) |
| ***G07D 7/12*** | (2016.01) |
| ***G07D 7/005*** | (2016.01) |
| *G09F 3/02* | (2006.01) |

(52) U.S. Cl.
CPC ..... *B42D 25/382* (2014.10); *B42D 25/42* (2014.10); *B42D 25/47* (2014.10); *G07D 7/005* (2017.05); *G07D 7/12* (2013.01); *G09F 3/0294* (2013.01); *G09F 3/0297* (2013.01); *G09F 3/0292* (2013.01); *G09F 2003/0247* (2013.01); *G09F 2003/0277* (2013.01)

(58) Field of Classification Search
USPC ..... 235/491, 494
See application file for complete search history.

(56) References Cited

FOREIGN PATENT DOCUMENTS

| | | | |
|---|---|---|---|
| KR | 10-2012-0116635 | A | 10/2012 |
| WO | WO 2017/090831 | A1 | 6/2017 |

* cited by examiner

PLASMONIC STRUCTURE HAVING AN IDENTIFIER PATTERN INDICATING A GENUINE PRODUCT AND METHOD OF USE FOR PREVENTING COUNTERFEITING, FALSIFICATION OR REUSE OF THE PRODUCT

CROSS-REFERENCE TO RELATED APPLICATIONS

This application claims priorities under 35 U.S.C. § 119 to Korean Patent Application Nos. 10-2017-0093746 and 10-2017-0103997 filed on Jul. 24, 2017 and Aug. 17, 2017, respectively, in the Korean Intellectual Property Office, the disclosure of which is incorporated herein by reference in its entirety.

TECHNICAL FIELD

The present disclosure relates to a structure for preventing counterfeit, falsification or reuse, its manufacturing method and a method for discriminating counterfeit, falsification or reuse using the same, and more particularly, to a structure for preventing counterfeit, falsification or reuse by means of an up-converting material and gap plasmon polariton in the gap, its manufacturing method and a method for discriminating counterfeit, falsification or reuse using the same.

BACKGROUND

Currently, counterfeits increasingly sell across all business day by day. To prevent counterfeiting and reuse of counterfeits, various technologies to prevent counterfeit and falsification using braille, hologram or special inks have been developed.

However, these technologies still do not eradicate counterfeits because counterfeit or falsification is committed through counterfeit experts, and counterfeit or falsification is difficult for users to discriminate. Moreover, the reuse of products such as packaging boxes and containers to which braille or hologram is attached poses a problem, making it more difficult to eradicate counterfeits.

In this circumstance, there is an earlier report of an anti-counterfeit structure using a plasmonic amplification phenomenon induced by metal nanowire and metal film with an up-conversion (UC) material that absorbs infrared light and emits visible light interposed between (Adv. Funct. Meter. 2016, 26,7836). However, this structure has a structural method for preventing the reuse, but to this end, it needs to use extra pollutants, and because there is no special encoding, attempts to reproduce may be made.

Therefore, in view of these many problems, there is a demand for the development of low-cost, easy-to-manufacture anti-counterfeit technology to prevent the reuse by discouraging attempts to reproduce through pattern encoding, and easily discriminate counterfeit.

RELATED LITERATURES

Patent Literatures (Patent Literature 1) Korean Patent Publication No. 10-2012-0116635

(Patent Literature 2) Korean Patent Publication No. 10-2011-0045194

SUMMARY

The present disclosure is designed to solve the aforesaid problems, and therefore, the present disclosure is directed to providing a structure for preventing counterfeit, falsification or reuse that allows a pattern indicating a genuine product to be easily identified with an eye through infrared light irradiation.

The present disclosure is further directed to providing a structure for preventing counterfeit, falsification or reuse that is fundamentally impossible to re-assemble after deformation of the structure in order to prevent counterfeit, falsification or reuse.

According to an aspect of the present disclosure, there is provided a structure for preventing counterfeit, falsification or reuse, including a metal layer, a photoconversion pattern layer including a plurality of photoconverting nanoparticles formed on the metal layer, a metal pattern layer placed on the metal layer and the photoconversion pattern layer, and an adhesive film placed on the metal pattern layer.

The metal pattern layer may be formed by islanded metal nanoparticles.

A gap plasmon polariton phenomenon may take place between the metal layer and the metal pattern layer.

The photoconversion pattern layer may form a second encoding pattern, the metal pattern layer may form a first encoding pattern, and a visible pattern area at which a photoconversion amplification phenomenon takes place when infrared light is applied may be formed at an overlapping part between the first encoding pattern and the second encoding pattern.

Each of the metal layer and the metal pattern layer may be independently any one selected from gold (Au), silver (Ag), copper (Cu), aluminum (Al), titanium (Ti), chromium (Cr), indium tin oxide (ITO), aluminum-doped zinc oxide (AZO), and fluorine-doped tin oxide (FTO).

The photoconverting nanoparticles may have an average diameter of 5 to 300 nm.

The photoconverting nanoparticles may be any one selected from the group consisting of halide, chalcogenide and metal oxide doped with ytterbium (Yb), erbium (Er), thulium (Tm), yttrium (Y) or mixtures thereof.

The adhesive film may be separated from the metal pattern layer by an external force or heat.

According to another aspect of the present disclosure, there is provided a method for manufacturing a structure for preventing counterfeit, falsification or reuse, including (a) forming a metal pattern on a substrate, (b) transferring the metal pattern to an adhesive film to manufacture the adhesive film having a metal pattern layer, (c) preparing a metal substrate, (d) forming a photoconversion pattern including photoconverting nanoparticles on the metal substrate to manufacture the substrate having a photoconversion pattern layer, and (e) placing the adhesive film having the metal pattern layer on the substrate having the photoconversion pattern layer to form a visible pattern area which is an overlapping part between the photoconversion pattern layer and the metal pattern layer.

The adhesive film at the step (b) may be an adhesive tape or a thermal release tape.

A gap plasmon polariton phenomenon may take place between the metal substrate and the metal pattern.

A photoconversion amplification phenomenon may take place at the visible pattern area at the step (e) when infrared light is applied.

The substrate at the step (a) may be a substrate having a layer of any one selected from graphene, transition metal dichalcogenide (TMDC) materials, graphite, SiC, SiNx, AlN, and diamond.

The metal pattern at the step (a) may be formed by any one method selected from photo lithography, electron beam lithography, X-ray lithography, ion beam lithography, and soft lithography.

The metal pattern at the step (a) may form a separate align key at a preset location so that a pattern matching to the align key may be transferred to the adhesive film together at the step (b).

The metal substrate at the step (c) may have imprint matching to the align key formed in the adhesive film.

The photoconversion pattern at the step (d) may be formed by patterning with the alignment to the imprint matching to the align key such that an overlapping part between the photoconversion pattern and the metal pattern may be formed.

After the adhesive film metal pattern and the photoconversion pattern on metal film are overlapped with the alignment to the imprint matching to the align key at the step (e), removing a transferred part of the pattern matching to the align key of the adhesive film may be additionally performed.

The photoconversion pattern may be formed by any one method selected from photo lithography, electron beam lithography, X-ray lithography, ion beam lithography, and soft lithography.

The metal pattern at the step (a) may be formed with a thickness of 2 to 15 nm.

After the step (a), a dewetting process involving heating at 200 to 1000° C. may be performed so that the metal pattern may be formed by islanded metal nanparticles.

After the step (b), removing graphene transferred to the adhesive film having the metal pattern layer may be additionally performed.

According to still another aspect of the present disclosure, there is provided a packaging box or container for preventing counterfeit, falsification or reuse including the structure.

The structure may be mounted on the surface or an opening of the packaging box or container.

According to further another aspect of the present disclosure, there is provided a method for discriminating counterfeit, falsification or reuse, including 1) applying infrared light to the structure, and (2) identifying counterfeit, falsification or reuse of the structure by identifying a light emission pattern appearing on the structure to which the infrared light is applied.

The step (2) may include identifying the light emission pattern with an eye or using a visible light detection device.

The structure for preventing counterfeit, falsification or reuse according to the present disclosure allows a pattern indicating a genuine product to be easily identified with an eye through infrared light irradiation.

Furthermore, the structure for preventing counterfeit, falsification or reuse according to the present disclosure is fundamentally impossible to re-assemble after deformation of the structure caused by disassembly of a packaging container, thereby preventing counterfeit, falsification or reuse.

DETAILED DESCRIPTION OF EMBODIMENTS

Hereinafter, many aspects and various embodiments of the present disclosure are described in further detail.

Hereinafter, the embodiments of the present disclosure are described in sufficient detail with reference to the accompanying drawings to enable those having ordinary skill in the technical field pertaining to the present disclosure to easily practice the present disclosure.

However, the following description is not intended to limit the present disclosure to particular embodiments, and in describing the present disclosure, when a detailed description of related known technology is deemed to render the essence of the present disclosure ambiguous, its detailed description is omitted herein.

The terminology used herein is for the purpose of describing particular embodiments only and is not intended to be limiting. As used herein, the singular forms are intended to include the plural forms as well, unless the context clearly indicates otherwise. It will be further understood that the term "comprises" or "comprising", when used in this specification, specify the presence of stated features, integers, steps, operations, elements, components, or groups thereof, but do not preclude the presence or addition of one or more other features, integers, steps, operations, elements, components, or groups thereof.

Figure 1:
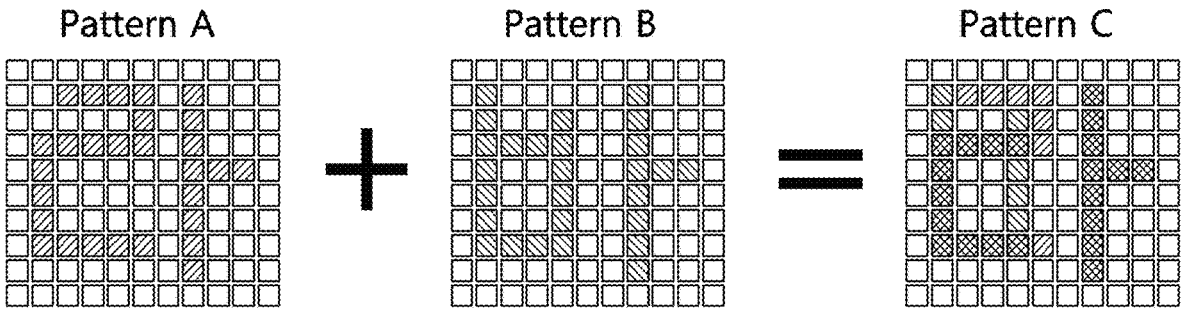
FIG. 1 shows an example of an encoding pattern for applying a plasmonic film of the present disclosure to counterfeit prevention.

FIG. 1 shows an example of an encoding pattern for applying a plasmonic film of the present disclosure to counterfeit prevention. Hereinafter, the structure for preventing counterfeit, falsification or reuse according to the present disclosure will be described with reference to FIG. 1. The structure of the present disclosure includes a metal layer; a photoconversion pattern layer; a metal pattern layer; and an adhesive film.

The metal layer may be of a 2-dimensional (2D) metal thin film type, and is preferably at least one metal selected from noble metal materials having low absorption loss in the metal itself, such as gold (Au), silver (Ag) and copper (Cu), or alloy containing at least one metal as a main component, but the scope of the present disclosure is not limited thereto, and all possible materials that can excite plasmons, including aluminum (Al), titanium (Ti), chromium (Cr), indium tin oxide (ITO), aluminum-doped zinc oxide (AZO), and fluorine-doped tin oxide (FTO), can be applied.

The thickness of the metal layer may be preferably 10 nm or more, and more preferably 100 nm or more, to obtain a sufficient gap plasmon polariton effect while blocking visible light penetration.

The photoconversion pattern layer may be formed by a plurality of photoconverting nanoparticles formed on the metal layer.

The photoconverting nanoparticles may be any one selected from the group consisting of halide, chalcogenide and metal oxide doped with ytterbium (Yb), erbium (Er), thulium (Tm), yttrium (Y) or their mixtures, but the scope of the present disclosure is not limited thereto, and all nanoparticles by which photoconversion can take place are available.

An average diameter of the photoconverting nanoparticles is closely related to a gap distance between the metal layer and the metal pattern layer, and the gap distance required to have a gap plasmon polariton effect may be appropriately selected based on the metal type of the metal layer and the metal pattern layer, and may be preferably 5 to 300 nm, and in case that the average diameter is beyond the lower limit and the upper limit, a gap plasmon polariton effect may not appear. Accordingly, the average diameter of the photoconverting nanoparticles is preferably 5 to 300 nm.

For example, in case that the metal layer and the metal pattern layer is made of silver (Ag), the average diameter of the photoconverting nanoparticles is preferably 5 to 300 nm. When the average diameter of the photoconverting nanoparticles is less than 5 nm, a gap plasmon polariton effect does not appear, and when the average diameter is greater than 300 nm, the gap distance between the metal layer and the metal pattern layer increases and a gap plasmon polariton effect does not appear, and thus, visible light may not be produced even upon irradiation with infrared light. That is to say, in case that the average diameter of the photoconverting nanoparticles is less than 5 nm or greater than 300 nm, for infrared light of 780-2000 nm wavelengths, the gap distance is outside of an effective gap distance for producing a gap plasmon polariton effect.

Accordingly, the thickness of the photoconversion pattern layer may be adjusted based on the average diameter of the coated photoconverting nanoparticles.

The metal pattern layer is placed on the metal layer and the photoconversion pattern layer. Accordingly, an overlapping part is formed in which the photoconversion pattern layer and the metal pattern layer overlap with each other, and this part may form a visible pattern area due to a gap plasmon polariton effect.

The metal pattern layer may be formed by islanded metal nanoparticles in a dewetting process.

The adhesive film may be placed on the metal pattern layer.

The adhesive film can easily separate from the metal pattern layer by an external force or heat, and may be an adhesive tape or a thermal release tape. The adhesive film may cap the structure per se, and after detached, the adhesive film may form a separate capping structure.

The metal pattern layer is preferably at least one metal selected from noble metal materials having low absorption loss in the metal itself, such as gold (Au), silver (Ag) and copper (Cu), or alloy containing at least one metal as a main component, but the scope of the present disclosure is not limited thereto, and all possible materials that can excite plasmons, including aluminum (Al), titanium (Ti), chromium (Cr), indium tin oxide (ITO), aluminum-doped zinc oxide (AZO), and fluorine-doped tin oxide (FTO), can be applied.

Accordingly, in the structure for preventing counterfeit, falsification or reuse according to the present disclosure, the metal pattern layer may form a first encoding pattern (corresponding to pattern A), the photoconversion pattern layer may form a second encoding pattern (corresponding to pattern B), and a visible pattern area may be formed at the overlapping part at which the first encoding pattern and the second encoding pattern are aligned on micro or nano level, where a photoconversion amplification phenomenon takes place when infrared light is applied.

Figure 2:
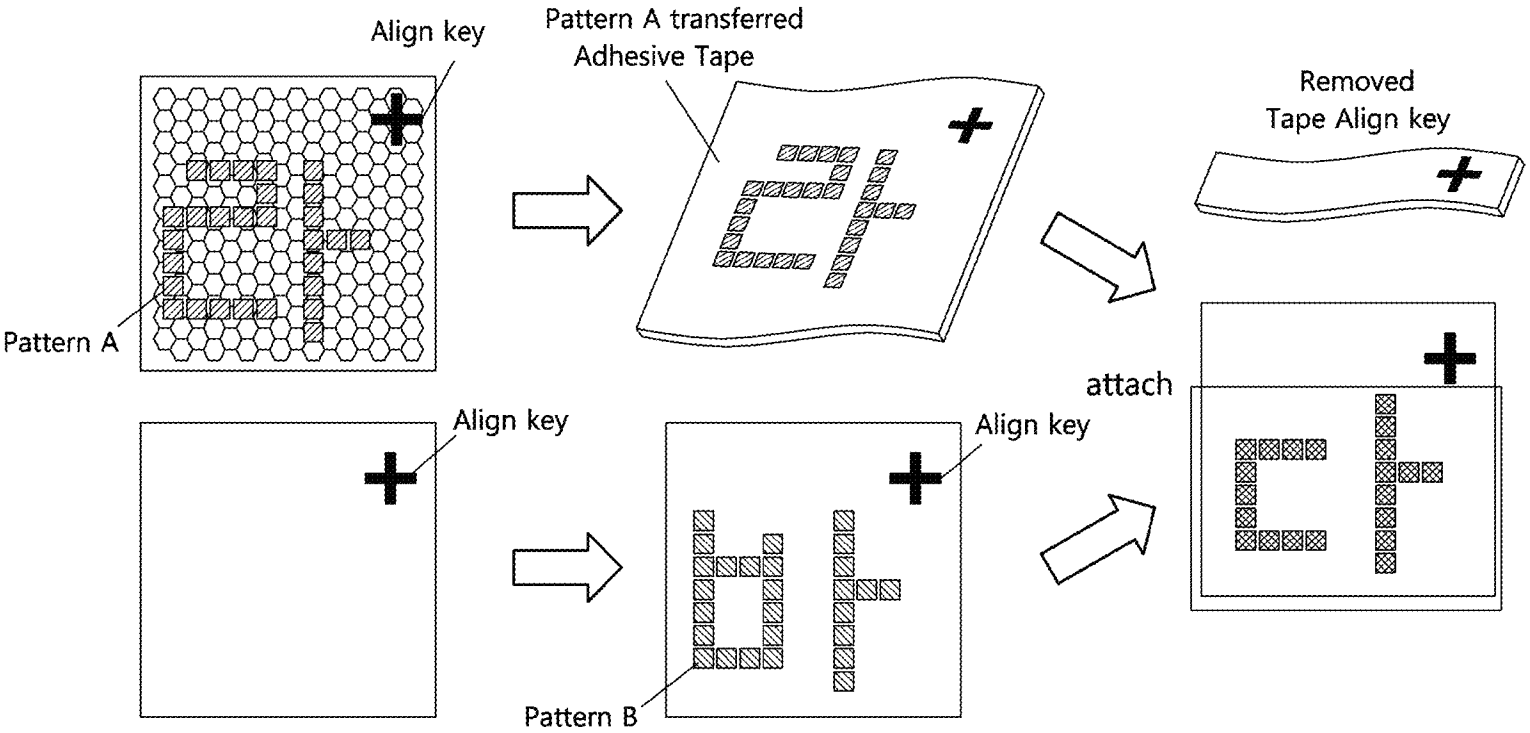
FIG. 2 is a process diagram showing a method for manufacturing a structure for preventing counterfeit, falsification or reuse according to the present disclosure.

FIG. 2 is a process diagram showing a method for manufacturing a structure for preventing counterfeit, falsification or reuse according to the present disclosure. Hereinafter, the method for manufacturing a structure for preventing counterfeit, falsification or reuse according to the present disclosure is described with reference to FIG. 2.

First, a metal pattern is formed on a substrate (Step a).

The substrate is preferably a substrate having a graphene layer, and the metal pattern (corresponding to pattern A) is preferably formed on the graphene layer. However, the scope of the present disclosure is not limited to the graphene layer, and all materials that can form a layer of 100 nm or less in thickness on the substrate, including 2D materials such as transition metal dichalcogenide (TMDC) materials, graphite, SiC, SiNx, AlN, and diamond, may be applied.

The metal pattern may be formed by a method such as photo lithography, electron beam lithography, X-ray lithography, ion beam lithography and soft lithography, but the scope of the present disclosure is not limited thereto.

The metal pattern may be formed by depositing a metal thin film with the thickness of 2 to 15 nm, and performing a dewetting process involving heating at the temperature of 200 to 1000° C. to form islanded metal nanoparticles.

The deposition of metal nanoparticles may be performed by a method such as spin coating, spray coating, dipping coating, and drop coating.

The metal pattern may form an encoding pattern as well as a separate align key at a preset location to facilitate the alignment with a photoconversion pattern that will be formed later.

Subsequently, the metal pattern is transferred to an adhesive film to manufacture the adhesive film having a metal pattern layer (step b).

The adhesive film can easily separate from the metal pattern layer by an external force or heat, and may be an adhesive tape or a thermal release tape. The adhesive film may cap the structure per se, and after detached, the adhesive film may form a separate capping structure.

A pattern matching to the align key formed at the step (a) may be transferred to the adhesive film together, to facilitate the alignment with a photoconversion pattern that will be formed later.

The step for removing graphene transferred to the adhesive film having the metal pattern layer may be additionally performed.

The adhesive film having the metal pattern layer itself may be used as an adhesive film having a plasmonic effect. Accordingly, the metal pattern layer may be transferred to a target device, and the adhesive film alone may be detached according to necessity.

Subsequently, a metal substrate is prepared (step c).

The metal substrate may have imprint matching to the align key formed in the adhesive film.

The metal substrate may be of a 2D metal thin film type, and may be at least one metal selected from noble metal materials having low absorption loss in the metal itself, such as gold (Au), silver (Ag) and copper (Cu), or alloy containing at least one metal as a main component.

The thickness of the metal substrate is preferably 10 nm or more to obtain a sufficient gap plasmon polariton effect while blocking visible light penetration.

Subsequently, a photoconversion pattern including photoconverting nanoparticles is formed on the metal substrate to manufacture the substrate having a photoconversion pattern layer (Step d).

The photoconversion pattern (corresponding to pattern B) may be formed by patterning with the alignment to the imprint matching to the align key on the metal substrate to form an overlapping part with the metal pattern.

The photoconversion pattern may be formed by photo lithography, electron beam lithography, X-ray lithography, ion beam lithography and soft lithography, but the scope of the present disclosure is not limited thereto.

A gap plasmon polariton phenomenon may take place between the metal substrate and the metal pattern.

Finally, the adhesive film having the metal pattern layer is placed on the substrate having the photoconversion pattern layer, to form a visible pattern area (corresponding to pattern C) which is the overlapping part between the photoconversion pattern layer and the metal pattern layer (Step e).

A photoconversion amplification phenomenon may take place at the visible pattern area when infrared light is applied.

Subsequently, it is preferable to additionally perform the step for removing a transferred part of the pattern matching to the align key of the adhesive film. When the align key is removed, it is practically impossible to re-assemble in the event that the structure is deformed, thereby preventing the reuse of the structure.

Figure 3:
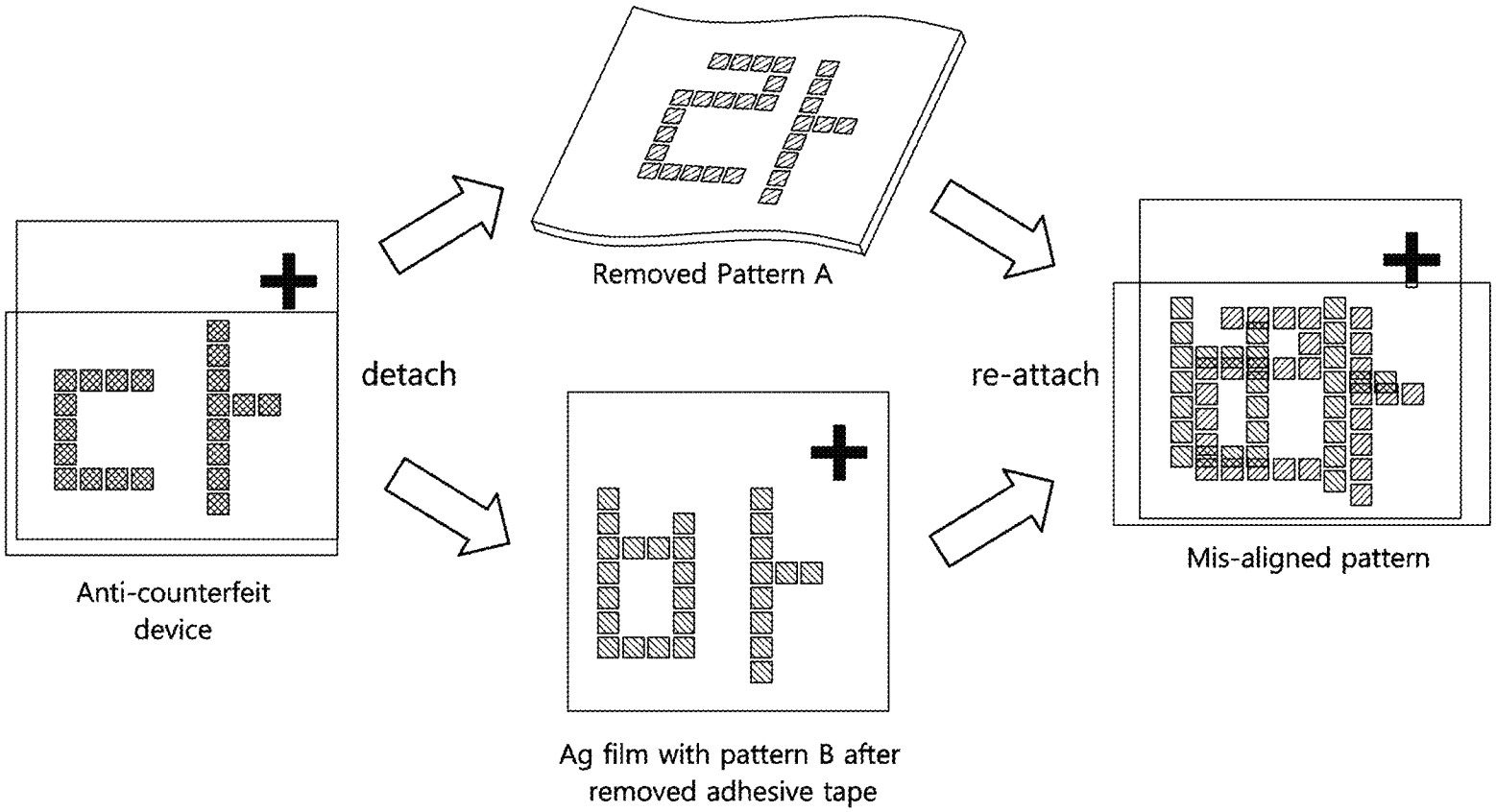
FIG. 3 shows that a complete structure for preventing counterfeit, falsification or reuse cannot be reused due to pattern mismatch when re-attaching the structure after artificially separating the structure.

FIG. 3 shows that the complete structure for preventing counterfeit, falsification or reuse cannot be reused due to pattern mismatch when re-attaching the structure after artificially separating the structure.

The present disclosure provides a packaging box or container for preventing counterfeit, falsification or reuse comprising the structure.

The structure may be mounted on the surface or an opening of the packaging box or container.

The present disclosure provides a method for discriminating counterfeit, falsification or reuse.

Specifically, first, infrared light is applied to the structure for preventing counterfeit, falsification or reuse according to the present disclosure (Step 1).

Subsequently, counterfeit, falsification or reuse of the structure is discriminated by identifying a light emission pattern appearing on the structure to which the infrared light is applied (Step 2).

The discrimination may be performed by identifying the light emission pattern (corresponding to pattern C of FIG. 1) with an eye or using a visible light detection device.

The method for discriminating counterfeit, falsification or reuse according to the present disclosure should be selectively used according to the purpose. That is, to discriminate counterfeit, falsification and reuse more accurately, a method which compares and analyzes the light emission intensity of visible light and the shape of the spectrum using a visible light detection device may be used.

Hereinafter, the present disclosure will be described in further detail through example, but the following example should not be construed as reducing or limiting the scope and the content of the present disclosure. Furthermore, based on the disclosure of the present disclosure including the following example, it is obvious that those skilled in the art could easily practice the present disclosure not presenting specific experimental results, and it is also obvious that these variations and modifications fall within the appended claims.

Furthermore, the experimental results presented below describe only representative experimental results of example and comparative example, and each effect of many embodiments of the present disclosure not providing an explicit statement below will be specifically described in the corresponding section.

EXAMPLES

Manufacturing Example 1: Manufacture of a Plasmonic Film

Figure 4:
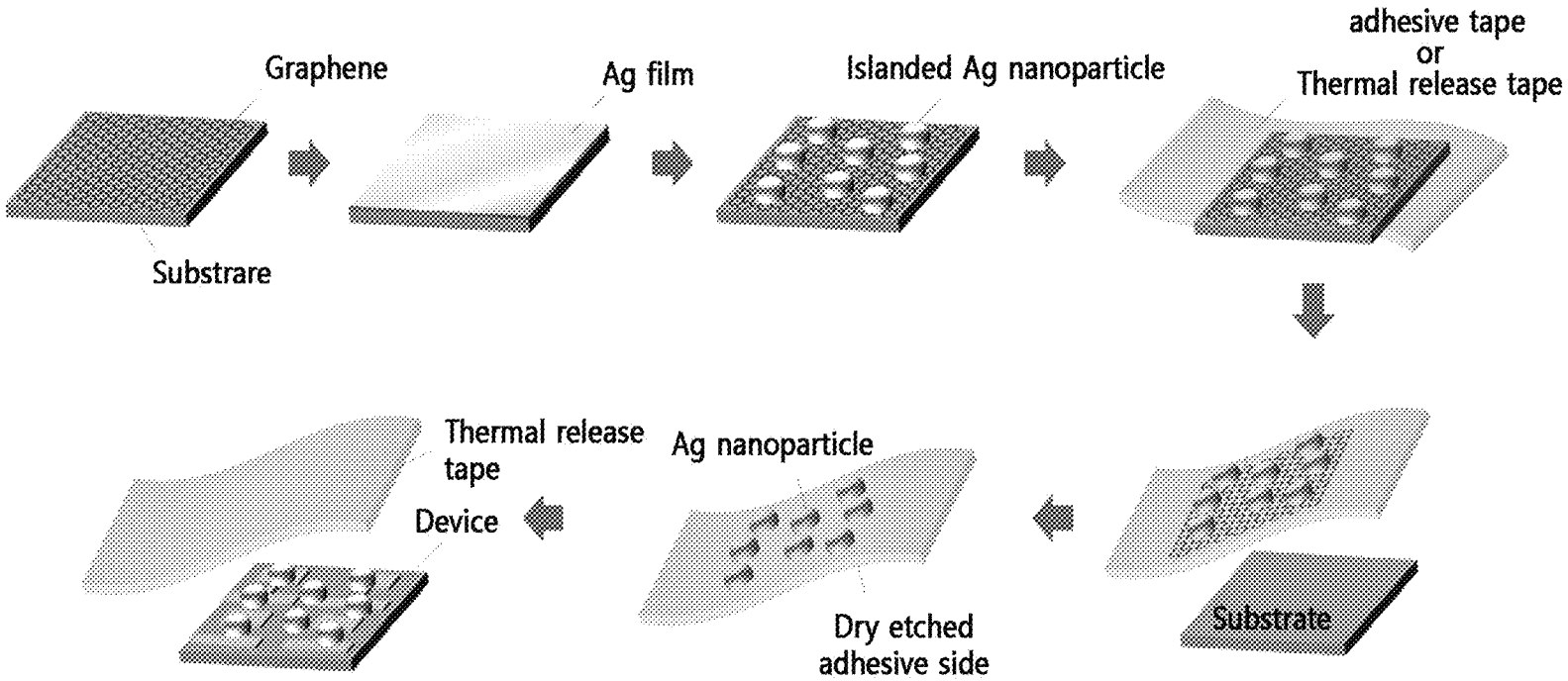
FIG. 4 shows a process for manufacturing a film having plasmonic properties and a process for applying it to a device.
Figure 5:
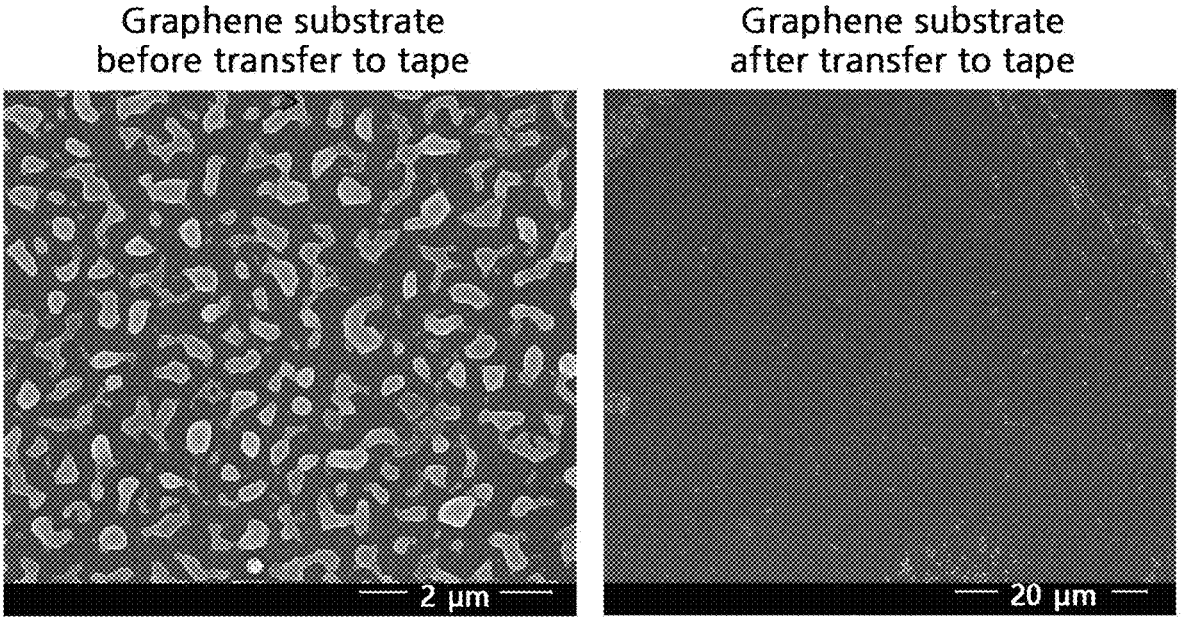
FIG. 5 shows scanning electron microscope (SEM) images of the surface of a graphene substrate on which Ag nanoparticles are formed and after Ag nanoparticles are transferred to an adhesive tape.

FIG. 4 shows a process for manufacturing a film having plasmonic properties and a process for applying it to a device. Following this, a $SiO_2$ substrate to which graphene has been transferred was prepared first, and a silver (Ag) thin film was deposited with the thickness of about 10 nm. The deposited Ag thin film was thermally treated in furnace equipment at the temperature of 450° C. to form islanded nanoparticles of dewetted Ag on the graphene layer. An adhesive tape was attached to the formed Ag nanoparticles. The attached adhesive tape was tightly pressed down to prevent the generation of bubbles. Subsequently, the tape was directly detached from the substrate without separate chemical treatment so that the Ag nanoparticles were adhered to an adhesive surface of the tape together with graphene. The tape itself may act as an adhesive film having high haze and a plasmonic effect. Scanning electron microscope (SEM) images of the surface of the graphene substrate on which the Ag nanoparticles are formed and after the Ag nanoparticles are transferred to the adhesive tape are shown in FIG. 5.

In this instance, to prevent an adverse influence of graphene on a device, $O_2$ plasma surface treatment is performed over graphene for a few seconds to remove graphene. Furthermore, in case that a thermal release tape is used instead of the adhesive tape, only the Ag nanoparticles may be transferred to a target device. The typical application temperature of the thermal release tape is around 100° C., and when this transfer method is used, it is advantageous in applying to a polymer device that should avoid chemical treatment or is vulnerable to high temperature treatment.

Figure 6:
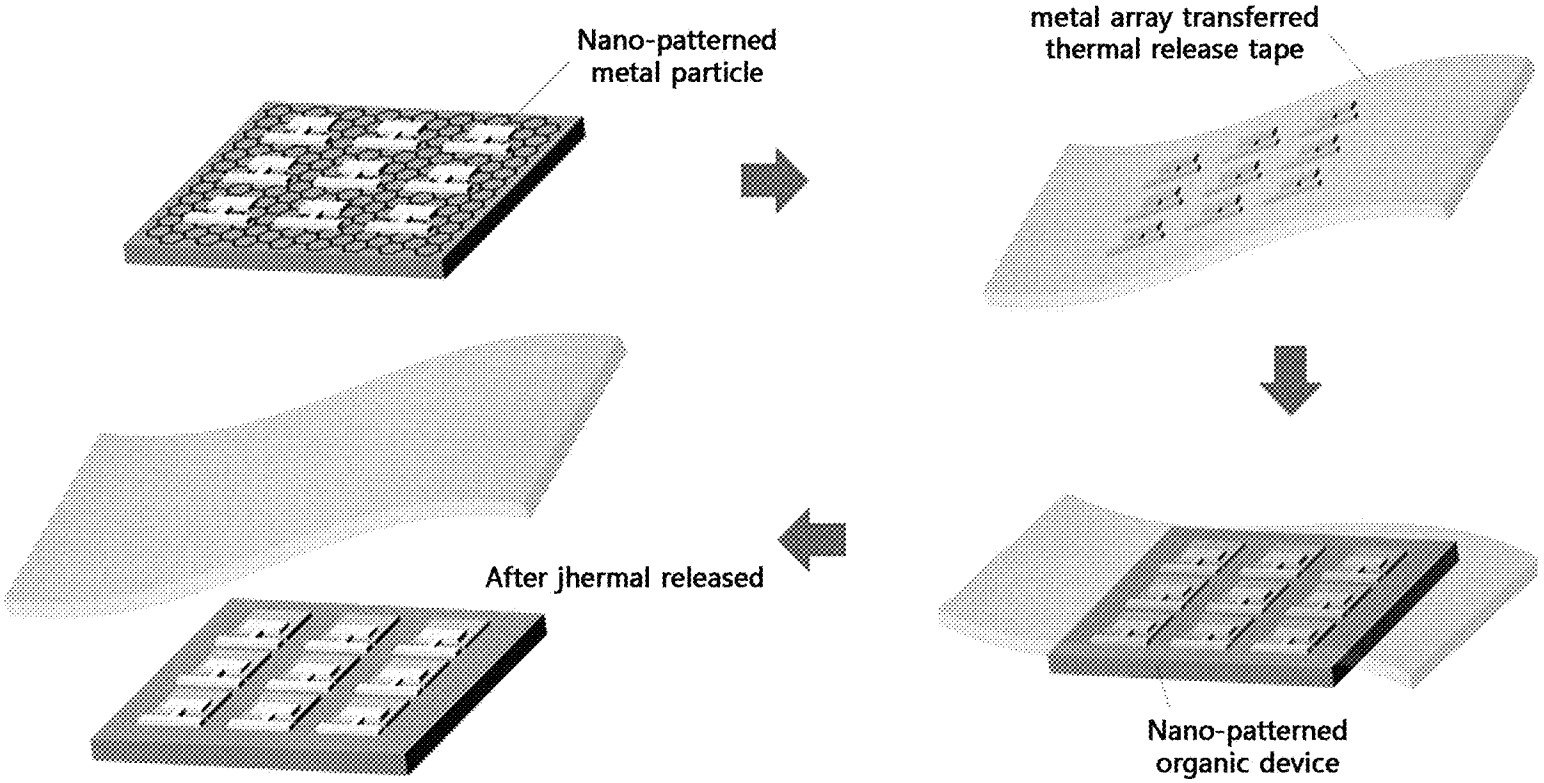
FIG. 6 shows a process of a method for manufacturing an adhesive film having a metal pattern layer consisting of metal nanoparticles and applying it to a device.

Manufacturing Example 2: Manufacture of an Adhesive Film Having a Metal Pattern Layer FIG. 6 shows a process of a method for manufacturing an adhesive film having a metal pattern layer consisting of metal nanoparticles and applying it to a device. Following this, a polymer nanopatterning method is being intensively studied on fabrication of an array such as imprinting technique, and there are many successful cases, but this method has a limitation because to form a device electrode, bottom electrode patterning should be selected to avoid the contact with chemicals and oxygen. However, when a device is made through a patterning transfer method, this limitation will be removed.

First, a $SiO_2$ substrate to which graphene has been transferred was prepared, and a metal electrode pattern was formed on graphene through electron beam lithography. A thermal release tape was attached onto the formed metal pattern and then detached, so that the metal pattern was transferred to a tape surface. In this instance, an unnecessary graphene part was removed by performing $O_2$ plasma surface treatment for a few seconds. Subsequently, after alignment was performed on target polymer arrays, the thermal release tape was attached properly to a target location. Here, in this condition, capping with the thermal release tape may be performed, and in this case, a separate sealing process may be omitted. Alternatively, when necessary, the thermal release tape may be peeled off by applying weak heat, and a separate sealing process may be performed.

Figure 7:
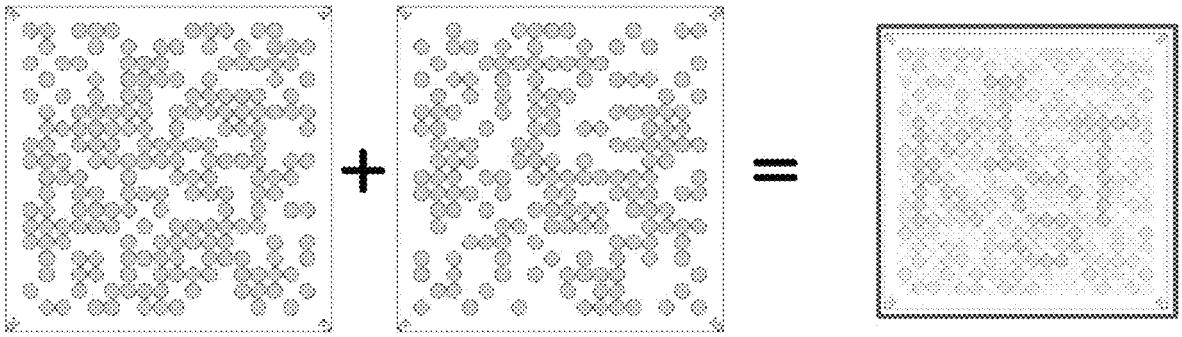
FIG. 7 shows schematically a metal pattern, a photoconversion pattern and a visible pattern of Example 1 of the present disclosure.
Figure 8:
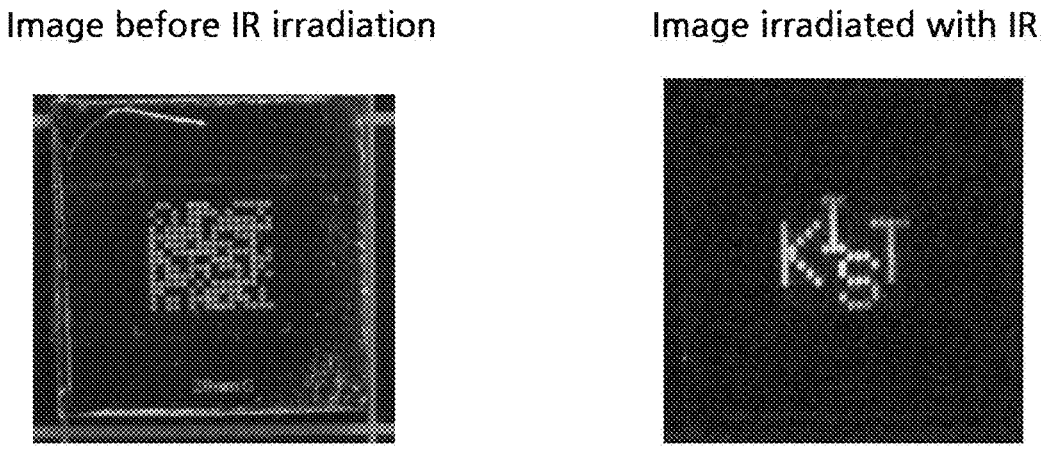
FIG. 8 shows photographic images of a structure for preventing counterfeit and falsification manufactured according to Example 1 before and after infrared light irradiation.

Example 1: Manufacture of a Structure for Preventing Counterfeit, Falsification or Reuse FIG. 7 shows schematically a metal pattern, a photoconversion pattern and a visible pattern of Example 1 of the present disclosure, and FIG. 8 shows photographic images of a structure for preventing counterfeit and falsification manufactured according to Example 1 before and after infrared light irradiation. Hereinafter, Example 1 is described with reference to FIGS. 7 and 8.

For pattern A, a silver (Ag) pattern film of 10 nm in thickness was formed on graphene/$SiO_2$ through patterning as in Manufacturing Example 2, a dewetting process was performed as in Manufacturing Example 1, and the processed silver (Ag) nanoparticle pattern was transferred to an adhesive tape, to manufacture the adhesive film having the silver pattern.

For pattern B, an Ag thin film substrate on which an incision has been created in the shape of an align key (not shown) was prepared. An Ag thin film was formed by forming a Ti adhesive layer on a silicon substrate with the thickness of 20 nm, and depositing Ag to prevent the Ag thin film from being separated from the substrate. An intaglio photoresist (PR; SU-8) pattern in the shape of pattern B was formed on the Ag thin film by patterning with the alignment to the align key, photoconversion nanoparticles ($\beta$-$NaYF_4$: $Yb^{3+}/Er^{3+}$) up-converting (IR to VIS) and having the average diameter of 20 nm were coated, and spin coating was performed at 3000 rpm for 30 seconds to manufacture a pattern layer of an photoconversion nanoparticle monolayer having a uniform thickness. In this instance, chloroform which is a solvent used in the coating process of photoconversion nanoparticles is fully volatilized during spin coating, and thus a drying process was not performed.

After a lift-off process is completed, pattern B of the photoconverting material of about 20 nm in size cannot be identified with an eye, and it is very difficult to identify the pattern even under a microscope.

When the transfer tape having the metal pattern layer with pattern A and the silver substrate having the photoconverting pattern with pattern B are aligned to the align key, a plasmonic structure of metal particle-photoconverting material-metal film is formed only at the location of real pattern C, leading to amplification of photoconverting light emission, while at the remaining area, only photoconverting material-metal film structure is formed, reducing light emission, or a metal particle-metal film structure is formed, failing to emit light due to the absence of a light emitting material.

In this instance, if the align key on the top of the tape is removed, even though the structure is deformed and then re-attached, alignment becomes difficult. Furthermore, in case that attaching and detaching repeats in the attempt of re-attaching, secondary damage may occur to the photoconverting material by the adhesive of the tape, making recovery more difficult.

Comparative Example 1: AgNP/Photoconverting/Glass

A structure was manufactured by the same method as Example 1 except that for a metal substrate, a glass substrate was used instead of a silver (Ag) thin film.

Comparative Example 2: Photoconverting/Glass

A structure was manufactured by the same method as Example 1 except that an photoconverting pattern was formed using a glass substrate for a metal substrate instead of a silver (Ag) thin film, and a process for attaching an adhesive tape with silver nanopattern was omitted.

Comparative Example 3: Photoconverting/Ag Film

A structure was manufactured by the same method as example 1 except that a process for attaching an adhesive tape with silver nanopattern was omitted.

Experimental Examples

Figure 9:
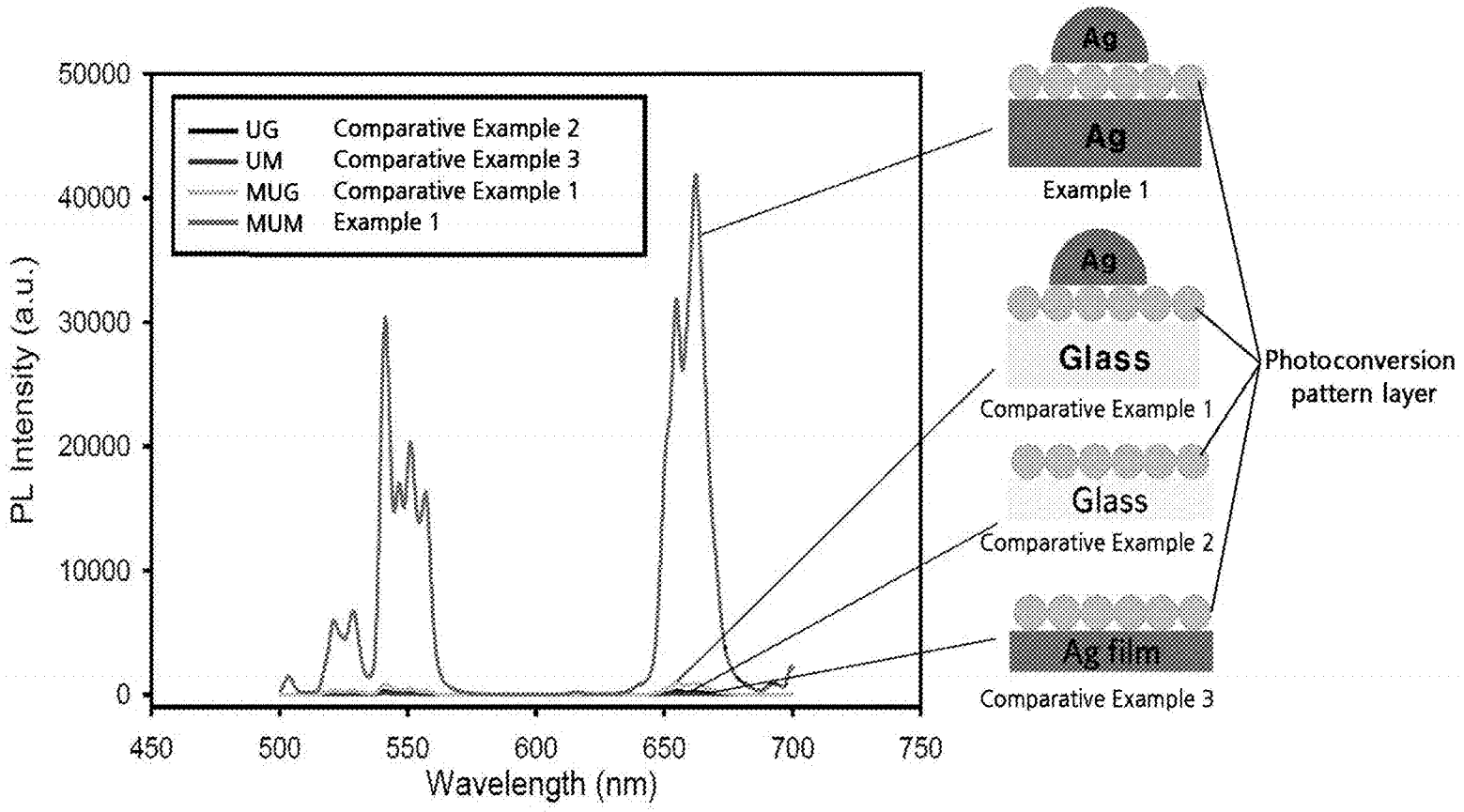
FIG. 9 is a graph showing the light emission intensity measured when infrared light is applied to each structure manufactured according to Example 1 and Comparative Examples 1 to 3.

Near-Infrared Light (980 nm) Up-Converting (Photoconversion) PL Spectra Analysis FIG. 9 is a graph showing the light emission intensity measured when infrared light is applied to each structure manufactured according to Example 1 and Comparative Examples 1 to 3.

According to FIG. 9, it was found that the light emission intensity of the structure manufactured according to Example 1 was higher 30 to 40 times than that of the structure of Comparative Example 1 in the wavelength regions of 520-560 nm and 640-680 nm.

Moreover, it was found that the structure of Comparative Example 3 reduced in light emission intensity due to a quenching effect.

Furthermore, the structure of Comparative Example 2 has a surface plasmon effect due to the presence of the metal pattern layer, but nevertheless, because of a structure with no metal substrate, it showed similar light emission intensity to the structure of Comparative Example 3.

That is, it can be seen that the structure according to the present disclosure emits visible light being identifiable with an eye when infrared light is applied, because of a gap plasmon polariton effect occurring in the gap between the metal pattern layer and the metal substrate.

Consequently, it can be seen that when the two encoded patterns are separated, the structure according to the present disclosure remarkably reduces in the intensity of visible light emitted and the visible pattern of the structure is not identified with an eye, and through this, it is possible to identify whether the structure according to the present disclosure is counterfeited, falsified and reused.

While the embodiments of the present disclosure have been hereinabove described, various modifications and changes may be made to the present disclosure by those having ordinary skill in the art with supplement, alternation, deletion or addition of the elements without departing from the spirit of the present disclosure defined in the appended claims, and these modifications and changes fall within the scope of protection of the present disclosure.

What is claimed is:

1. A plasmonic structure having an identifier pattern indicating a genuine product for preventing counterfeiting, falsification or reuse, comprising:

a metal layer;

a photoconversion pattern layer including a plurality of photoconverting nanoparticles disposed in a pattern on and in direct contact with the metal layer;

a metal pattern layer including a plurality of metal particles disposed in a pattern on and in direct contact with the photoconversion pattern layer; and an adhesive film disposed on the metal pattern layer.

2. The plasmonic structure according to claim 1, wherein the metal pattern layer is constituted by islanded metal nanoparticles.

3. The plasmonic structure according to claim 1, wherein the metal layer and the metal pattern layer are structured to interact to provide a gap plasmon polariton phenomenon for the plasmonic structure.

4. The plasmonic structure according to claim 1, wherein the metal pattern layer provides a first encoding pattern, the photoconversion pattern layer provides a second encoding pattern, and the first encoding pattern and the second encoding pattern overlap and define said identifier pattern within a visible pattern area at which a photoconversion amplification phenomenon takes place when infrared light is applied.

5. The plasmonic structure according to claim 1, wherein the metal layer and the metal pattern layer independently comprise a material selected from the group consisting of gold (Au), silver (Ag), copper (Cu), aluminum (Al), titanium (Ti), chromium (Cr), indium tin oxide (ITO), aluminum-doped zinc oxide (AZO), and fluorine-doped tin oxide (FTO).

6. The plasmonic structure according to claim 1, wherein the plurality of photoconverting nanoparticles have an average diameter ranging from 10 to 300 nm.

7. The plasmonic structure according to claim 1, wherein the plurality of photoconverting nanoparticles comprise one or more materials selected from the group consisting of a halide, a chalcogenide, and a metal oxide doped with ytterbium (Yb), erbium (Er), thulium (Tm), yttrium (Y) or mixtures of ytterbium (Yb), erbium (Er), thulium (Tm), and yttrium (Y).

8. A product or product container including the plasmonic structure of claim 1 which has a predetermined identifier pattern indicating authenticity of the product or product container for preventing counterfeiting, falsification or reuse of the product or product container.

9. A method for determining authenticity of a product for preventing counterfeiting, falsification or reuse thereof, comprising:

applying infrared light to the plasmonic structure of claim 1 to generate a light emission pattern;

detecting the presence of the light emission pattern appearing on the plasmonic structure to which the infrared light is applied; and determining authenticity of the product if the light emission pattern matches the identifier pattern indicating a genuine product.

10. The method according to claim 9, wherein detecting the presence of the light emission pattern and determining authenticity of the product is accomplished by visual inspection by an observer or by using a visible light detection device.

11. A method for manufacturing a plasmonic structure having an identifier pattern indicating a genuine product for preventing counterfeiting, falsification or reuse, the method comprising steps including:

(a) forming a metal pattern including a plurality if metal particles disposed in a pattern on a substrate;

(b) transferring the metal pattern to an adhesive film to provide a patterned adhesive film having a metal pattern layer thereon;

(c) preparing a metal substrate;

(d) forming a photoconversion pattern including a plurality of photoconverting nanoparticles disposed in a pattern directly on and in contact with the metal substrate to provide a patterned substrate having a photoconversion pattern layer thereon; and (e) placing the metal pattern layer on and in contact with the photoconversion pattern layer to overlap at least a portion of the photoconversion pattern layer and the metal pattern layer to define said identifier pattern within a visible pattern area.

12. The method according to claim 11, wherein the substrate on which the metal pattern is formed comprises a material selected from the group consisting of graphene, transition metal dichalcogenide (TMDC) materials, graphite, SiC, SiNx, AlN, and diamond.

13. The method according to claim 11, wherein the metal pattern formed on the substrate includes an alignment key separately disposed at a preset location so that a pattern corresponding to the alignment key is transferred to the adhesive film in addition to the metal pattern.

14. The method according to claim 13, wherein the metal substrate prepared prior to forming the photoconversion pattern thereon has an imprint that matches the alignment key transferred to in the adhesive film.

15. The method according to claim 14, further comprising, after placing the metal pattern layer on the photoconversion pattern layer, removing a portion of the adhesive film that includes the pattern corresponding to the alignment key.

16. The method according to claim 14, wherein the photoconversion pattern formed on the metal substrate is formed by aligning the imprint that matches the alignment key with the alignment key so that at least a portion of the photoconversion pattern and the metal pattern overlap.

17. The method according to claim 11, the metal pattern formed on the substrate has a thickness ranging from 2 to 15 nm.

18. The method according to claim 11, further comprising, after forming the metal pattern on the substrate, performing a dewetting process by heating the metal pattern on the substrate to a temperature ranging from 200 to 1000° C. so that the metal pattern is formed by islanded metal nanoparticles.

19. The method according to claim 11, wherein the substrate comprises graphene, and the method further comprises removing the graphene transferred to the adhesive film having the metal pattern layer thereon.

* * * * *